US009546647B2

(12) United States Patent
Longsworth

(10) Patent No.: US 9,546,647 B2
(45) Date of Patent: Jan. 17, 2017

(54) GAS BALANCED BRAYTON CYCLE COLD WATER VAPOR CRYOPUMP

(75) Inventor: Ralph Longsworth, Allentown, PA (US)

(73) Assignee: SUMITOMO (SHI) CRYOGENICS OF AMERICA INC., Allentown, PA (US)

( * ) Notice: Subject to any disclaimer, the term of this patent is extended or adjusted under 35 U.S.C. 154(b) by 884 days.

(21) Appl. No.: 13/489,635

(22) Filed: Jun. 6, 2012

(65) Prior Publication Data

US 2013/0008190 A1 Jan. 10, 2013

Related U.S. Application Data

(60) Provisional application No. 61/504,810, filed on Jul. 6, 2011.

(51) Int. Cl.

| | |
|---|---|
| ***B01D 8/00*** | (2006.01) |
| ***F04B 37/08*** | (2006.01) |
| ***F25B 9/14*** | (2006.01) |

(52) U.S. Cl.

CPC *F04B 37/08* (2013.01); *F25B 9/14* (2013.01)

(58) Field of Classification Search

CPC ..... F04B 47/08; F25B 9/14; B01D 8/00
USPC ..... 62/55.5, 6, 403, 401, 402
See application file for complete search history.

(56) References Cited

U.S. PATENT DOCUMENTS

| | | | | |
|---|---|---|---|---|
| 3,010,220 A | | 11/1961 | Schueller | |
| 3,175,373 A | | 3/1965 | Holkeboer et al. | |
| 3,338,063 A | | 8/1967 | Hogan et al. | |
| 3,613,385 A | | 10/1971 | Hogan et al. | |
| 3,768,273 A | | 10/1973 | Missimer | |
| 4,150,549 A | | 4/1979 | Longsworth | |
| 4,951,471 A | * | 8/1990 | Sakitani et al. | 62/51.2 |
| 5,181,383 A | | 1/1993 | Goto et al. | |
| 5,582,017 A | * | 12/1996 | Noji et al. | 62/55.5 |

(Continued)

FOREIGN PATENT DOCUMENTS

| | | |
|---|---|---|
| CN | 101469689 A | 7/2009 |
| EP | 0919722 B1 | 7/2003 |

(Continued)

OTHER PUBLICATIONS

International Search Report and the Written Opinion of the International Searching Authority dated Oct. 4, 2012, from corresponding International Application No. PCT/US2012/044104.

(Continued)

*Primary Examiner* — Melvin Jones
(74) *Attorney, Agent, or Firm* — Katten Muchin Rosenman LLP

(57) ABSTRACT

The primary invention is to cool a water vapor cryopump using a Gas Balanced Brayton cycle refrigerator. The refrigerator is comprised of a compressor, a gas balanced reciprocating engine and a counterflow heat exchanger. It is connected to the cryopump through insulated transfer lines. Options include a gas storage volume with valves that can adjust system pressures, a variable speed engine, gas lines between the compressor and cryopanel that by-pass the engine, and a gas line that by-passes the heat exchanger. This system can cool down and warm up rapidly, rapidly warm and cool the cryopanel without warming the engine, and reduce power input when the cryopanel heat load is reduced.

13 Claims, 1 Drawing Sheet

(56) References Cited

U.S. PATENT DOCUMENTS

| | | | | |
|---|---|---|---|---|
| 5,687,574 | A | 11/1997 | Longsworth et al. | |
| 6,161,392 | A | 12/2000 | Jirnoa et al. | |
| 6,374,617 | B1 * | 4/2002 | Bonaquist et al. | 62/6 |
| 6,438,994 | B1 | 8/2002 | Rashad et al. | |
| 6,574,978 | B2 | 6/2003 | Flynn et al. | |
| 2007/0253854 | A1 | 11/2007 | Dunn | |
| 2010/0275616 | A1 | 11/2010 | Saji et al. | |
| 2011/0219810 | A1 | 9/2011 | Longsworth | |
| 2012/0085121 | A1 | 4/2012 | Longsworth | |

FOREIGN PATENT DOCUMENTS

| | | | |
|---|---|---|---|
| EP | 2211124 | A1 | 7/2010 |
| JP | 4-236069 | | 8/1992 |
| JP | 11-248280 | | 9/1999 |
| SU | 1325195 | | 7/1987 |
| WO | 97/33671 | A1 | 9/1997 |
| WO | 2008/133965 | A1 | 11/2008 |

OTHER PUBLICATIONS

R. Khefer. Cryopumps-Refrigerators, Kriovakuumnaya tekhnika. Osnovy i primeneniya. Moskva, Energoatomizdat, 1983, p. 144-145.

Korean Office Action dated Mar. 25, 2014 from corresponding Korean Application No. 10-2014-7001333, with English-language translation.

Specification and Drawings of U.S. Appl. No. 13/106,218 cited in the specification.

C.B. Hood, et al "Helium Refrigerators for Operation in the 10-30 K Range" Advances in Cryogenic Engineering, vol. 9, Plenum Press, New York (1964), pp. 496-506.

Extended European Search Report dated Mar. 26, 2015 for the Corresponding European Patent Application No. 12807347.5.

Chinese Office Action dated Dec. 3, 2014 for the Corresponding Chinese Patent Application No. 201280043152.9.

European Office Action dated Apr. 1, 2016 for the Corresponding European Patent Application No. 12807347.5.

* cited by examiner

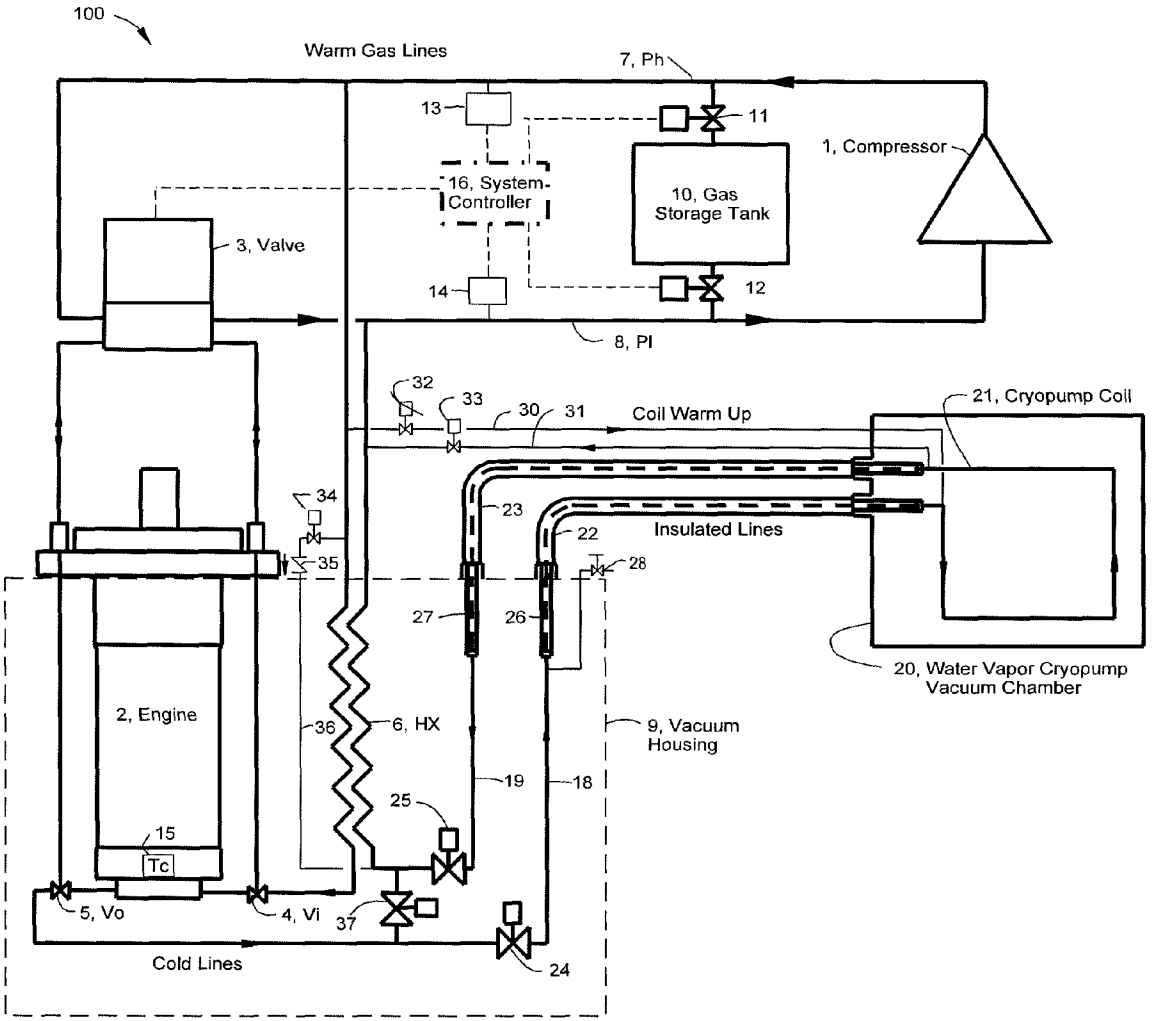
100
Warm Gas Lines
1, Compressor
7, Ph
11
10, Gas Storage Tank
12
8, PI
13
16, System-Controller
14
3, Valve
21, Cryopump Coil
20, Water Vapor Cryopump Vacuum Chamber
Coil Warm Up
Insulated Lines
9, Vacuum Housing
28
Tc
22
31
30
23
26
18
19
24
33
32
27
6, HX
25
37
34
35
36
4, Vi
2, Engine
15
Tc
5, Vo
Cold Lines

GAS BALANCED BRAYTON CYCLE COLD WATER VAPOR CRYOPUMP

BACKGROUND OF THE INVENTION

1. Field of the Invention

This invention relates to a water vapor cryopump cooled by a Gas Balanced Brayton cycle refrigerator, typically having input power in the range of 5 to 20 kW.

2. Background Information

Three recent patent applications assigned to SHI Cryogenics describe gas balanced Brayton cycle expansion engines and a control system that minimizes cool down time from room temperature to cryogenic temperatures. A system that operates on the Brayton cycle to produce refrigeration consists of a compressor that supplies gas at a discharge pressure to a counterflow heat exchanger, which admits gas to an expansion space through a cold inlet valve, expands the gas adiabatically, exhausts the expanded gas (which is colder) through in outlet valve, circulates the cold gas through a load being cooled, then returns the gas through the counterflow heat exchanger to the compressor.

Patent application Ser. No. 61/313,868 dated Mar. 15, 2010 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. Patent application Ser. No. 61/391,207 dated Oct. 8, 2010 by R. C. Longsworth describes the control of a reciprocating expansion engine operating on a Brayton cycle, as described in the previous application, which enables it to minimize the time to cool a mass to cryogenic temperatures. U.S. patent application Ser. No. 13/106,218 dated May 12, 2011 by S. Dunn, et al., describes alternate means of actuating the expander piston. The engines described in patent application 61/313,868 and Ser. No. 13/106,218 are referred to in this application as "Gas Balanced Brayton cycle engines". This engine has a lot of advantageous characteristics when it is used to cool a cryopanel that is condensing water vapor at temperatures in the range of 110 K to 170 K. The compressor system that is used in this application to illustrate the innovations is described in published patent application US 2007/0253854 titled "Compressor With Oil Bypass" by S. Dunn filed on Apr. 28, 2006.

Starting in the late 1950's a lot of work was done in cryopumping technology to support the space program. U.S. Pat. No. 3,010,220 dated Nov. 28, 1961 by Schueller describes a space chamber with cryopanels cooled by liquid cryogens. U.S. Pat. No. 3,175,373 dated Mar. 30, 1965 by Holkeboer, et al., describes a large vacuum system that has conventional mechanical and diffusion pumps, and liquid cryogen cooled cryopanels. A paper by C. B. Hood, et al., titled "Helium Refrigerators for Operation in the 10-30 K Range" in *Advances in Cryogenic Engineering, Vol.* 9, Plenum Press, New York (1964), pp 496-506, describes a large Brayton cycle refrigerator having a reciprocating expansion engine capable of producing more than 1.0 kW of refrigeration at 20 K. This refrigerator was developed to cryopump air in a large space chamber. An early small cryopump cooled by liquid nitrogen and a GM refrigerator is described in U.S. Pat. No. 3,338,063, dated Aug. 29, 1967, by Hogan, et al. GM type refrigerators that draw less than 10 kW of input power have dominated the market for cooling cryopanels that pump all gases since then, U.S. Pat. No. 4,150,549 dated April 1979 by Longsworth, is an example. Starting in the early 1970's cryopumping water vapor at temperatures in the range of 120 K to 170 K and capacities of 500 to 3,000 W have been dominated by refrigerators that use mixed gases as described in U.S. Pat. No. 3,768,273 dated Oct. 30, 1973 by Missimer. A more recent patent, U.S. Pat. No. 6,574,978 dated Jun. 10, 2003 by Flynn, et al., describes means of controlling the rate of cooling and heating a refrigerator of this type.

The present application is a departure from present practice of using mixed gas refrigerant refrigerators having capacities of about 500 to 3,000 W at about 150 K to pump water vapor, by using a Gas Balanced Brayton cycle refrigerator which typically circulates helium.

SUMMARY OF THE INVENTION

A Gas Balanced Brayton refrigerator is used to cool a cryopanel, in a vacuum chamber, that operates at a temperature in the range of 110 K to 170 K to pump water vapor. The additions of a gas storage tank and valves that can be used to put gas from the refrigerator into the tank or return it to the refrigerator enable the high and low pressures to be adjusted without losing gas from the system. The engine speed can also be varied. The ability to control the pressures and engine speed enable fast cooldown by operating the compressor at maximum capacity during cool down. The ability to control the pressures and engine speed also enables power to be reduced during operation when the cooling load is reduced. By adjusting the operating pressure ratio it is further possible to adjust the temperature difference between the inlet and outlet of the cryopanel. In addition rapid warm up and cool down of the cryopanel are accomplished by having warm gas lines and valves that cycle most of the compressor flow to the cryopanel while maintaining some flow through the engine and heat exchanger to keep them cold. Another feature is a by-pass line around the refrigerator heat exchanger that enables rapid warm up of the engine and heat exchanger.

BRIEF DESCRIPTION OF THE DRAWINGS

FIG. 1 shows system 100 which includes the basic components of a water vapor cryopump cooled by a Gas Balanced Brayton cycle refrigerator and ancillary equipment.

DESCRIPTIONS OF THE PREFERRED EMBODIMENTS

FIG. 1 is a schematic view of system 100, a water vapor cryopump cooled by a Gas Balanced Brayton cycle refrigerator including additional piping and controls that enable a lot of novel features to be achieved.

The basic components of the Gas Balanced Brayton cycle refrigerator include compressor 1, engine 2, counterflow heat exchanger 6, warm gas line 7 at high pressure, and warm gas line 8 at low pressure. Engine 2 is shown as having inlet valve 4 and outlet valve 5 being actuated pneumatically by gas controlled by rotary valve 3. This engine is described more fully in patent application Ser. No. 13/106,218 and additional designs are described in patent application Ser. No. 61/313,868. Engine 2 and heat exchanger 6 are mounted in vacuum housing 9. Patent application Pup. No. US 2007/0253854 describes the oil lubricated horizontal scroll compressor and system that comprise compressor 1 and which is used to illustrate the features of the present invention.

Water vapor cryopumping coil, or cryopanel, 21 is mounted in water vapor cryopump vacuum chamber 20. Insulated line 22 carries cold gas from engine 2 to coil 21 and insulated line 23 returns warmer cold gas back to heat exchanger 6. Insulated lines 22 and 23 are shown as being removeably connected at each end by virtue of bayonet connectors 26 and 27 at vacuum housing 9 and similar bayonets at chamber 20, not shown. Cold gas line 18 between engine 2 and bayonet 26 has a shut off valve 24. Similarly cold gas line 19 between bayonet 27 and heat exchanger 6 has a shut off valve 25. By-Pass valve 37 connects the cold gas line from engine outlet valve 5 to the return side of heat exchanger 6. Pump out valve 28 connects into cold line 18 just below bayonet 26.

Cryopump coil 21 has connections to coil warm up lines 30 and 31 that connect to warm gas lines 7 an 8 through valves 32 and 33 respectively. Heat exchanger 6 is warmed up using by-pass line 36 which has normally closed valve 34 and pressure relief valve 35 in line. Gas can be supplied to the system when it is first connected, and as it cools down, from an external cylinder connected to low pressure line 8 but it may be lost when the system warms. The addition of gas storage tank 10 and valves 11 and 12, which connect tank 10 to high pressure line 7 and low pressure line 8 respectively, allows gas to be saved under normal operation, and to adjust the pressures in the system to achieve some of the innovations that are possible with this system. Some gas will be lost if any components beyond shut off valves 24 and 25 are removed, or if there is a failure in the piping. Valve 11 and high pressure line 7 are a means for storing gas from said refrigerator at a high pressure. Valve 10 and low pressure line 8 are a means for returning gas to the refrigerator at a low pressure.

A system controller 16 receives input from high pressure transducer 13, low pressure transducer 14, cold engine temperature sensor 15, and other sensors as needed for specific control functions, and puts out signals that control engine speed through a line that connects to rotary valve 3, pressure control valves 11 and 12, coil warm up valves 32 and 33, heat exchanger warm up valve 34, cold supply and return valves 34 and 35, by-pass valve 37, and other optional controls that are not illustrated.

It is assumed that prior to connecting the refrigerator to vacuum chamber 20 that the refrigerator has been charged with gas. The use of both helium, a monatomic gas, and nitrogen, a diatomic gas, are illustrated in this application. Valves 24, 25, 32, and 33 are closed in order to retain the gas. Cryopump coil 21 in vacuum chamber 20 is connected to lines 18 and 19 in vacuum housing 9 by inserting and sealing insulated lines 22 and 23 in bayonets 26 and 27 at the refrigerator ends and similar bayonets at vacuum chamber 20 ends. Coil warm up lines 30 and 31 are connected to valves 32 and 33. Whatever gas is in these lines at the time they are connected is removed using a small vacuum pump connected to pump out port 28. Valves 24 and 25 are then opened and refrigerant flows to the lines from storage tank 10 and possibly from an external gas cylinder. Vacuum chamber 20 is evacuated prior to cool down.

Cryopump coil 21 is cooled down with by-pass valves 32, 33, 34, and 37 closed Initial fast cool down of engine 2, heat exchanger 6, cold lines 18 and 19, insulated lines 22 and 23, and cryopump coil 21 is done with the by-pass valves just listed closed and valves 24 and 25 open. Fast cool down is accomplished by operating the compressor at its maximum input power throughout cool down, 2.2 MPa high pressure and 0.8 MPa low pressure for the present compressor. During this period of time gas is added to the system and the speed of engine 2 is reduced approximately in proportion to the absolute temperature of cryopump coil 21. The present engine speed would drop from about 6 Hz to 3 Hz.

Rapid regeneration of cryopump coil 21 is accomplished by isolating it from the rest of the system and warming it while keeping the rest of the cold components cold. Cold supply valve 24 and cold return valve 25 are closed, by-pass valve 37 is opened, and then coil warm up by-pass valves 32 and 33 are opened. The speed of engine 2 is set to maintain its operating temperature. This might be a speed of about 1 Hz for the present engine. Most of the flow from the compressor flows into cryopump coil 21 at room temperature and warms it. Flow rate through cryopump coil 21 is set in part by the restrictions in lines 30 and 31 and valves 32 and 33, or a separate control valve can be added (not shown). Flow from the compressor can be maximized while keeping power input low by operating with the low pressure near its maximum value and a low high pressure, eg 0.8 MPa and 1.4 MPa respectively.

Using by-pass line 36 in conjunction with other valves either the entire cold part of the system can be warmed rapidly, or engine 2 and heat exchanger 6 can be warmed independently. To warm the entire cold section the valves are left in their normal operating condition with the exception of heat exchanger by-pass valve 34 which is opened. Relief valve 35 is set to maintain a high to low pressure difference of about 0.5 MPa and the low pressure would be set to about 0.8 MPa for fastest warm up with the present compressor. The speed of engine 2 is set low enough to maintain a pressure difference greater than 0.5 MPa to balance the gas flow through engine 2 with the flow through by-pass line 36 and coil 21 in order to have a uniform warm up rate of all the components. To warm up engine 2 and heat exchanger 6 without warming the balance of the cold components, by-pass valve 34 is opened, valves 24 and 25 are closed, and by-pass valve 37 is opened. Pressures and engine speed are set as previously described.

Power can be saved if the cooling load is reduced. In scroll compressors almost all of the gas that enters the first pocket flows out, the mass flow rate being in almost direct proportion to the inlet pressure. Input power is a function of the high and low pressure and is reduced by reducing the low pressure and pressure ratio. Refrigeration is also reduced. An example of the power reduction for the present scroll compressor is given in Table 1. This example uses the displacement of the compressor to calculate the mass flow rate but then assume adiabatic processes with no losses in calculating the power input, the refrigeration rate, and the temperature change in the gas as it enters and leaves engine 2, then warms the same amount as it flows through cryopump coil 21. Actual input power is about 50% higher and thermal losses in the refrigerator and transfer lines reduce the temperature change by about 25%. It is assumed that the speed of engine 2 is adjusted to use all of the flow at the pressures that are set. Variable speed of engine 2 has been assumed, but if a fixed speed corresponding to an optimum speed when cold, eg. around 3 Hz for the present expander, is set, then power reduction is still achievable but cool down and warm is slower because some gas is by-passed in compressor 1 at higher temperatures.

While the present system has been designed for helium, Table 1 also shows an example for nitrogen. Nitrogen has a smaller temperature change when it is compressed and expanded compared with helium and is thus a more efficient refrigerant. Both examples use a compressor displacement of 338 L/m to calculate the flow rate.

TABLE 1

Comparison of calculated ideal adiabatic input power, cooling, and temperature change in the gas flowing in and out of the expander, for helium and nitrogen.

| | | | | |
|---|---|---|---|---|
| Gas | He | | | |
| Density @ 300K, 1 atm-g/L | 0.1625 | | | |
| Cp - J/g K | 5.2 | | | |
| Tin - K | 300 | | | |
| Ph - MPa | 2.2 | 1.4 | 1.7 | 1.1 |
| Pl - Mpa | 0.8 | 0.8 | 0.6 | 0.6 |
| Pr | 2.75 | 1.75 | 2.83 | 1.83 |
| Flow rate - g/s | 7.32 | 7.32 | 5.49 | 5.49 |
| Adiabatic power - kW | 5.70 | 2.87 | 4.43 | 2.35 |
| Expander Tin - K | 140 | 140 | 140 | 140 |
| Expander Tout - K | 93 | 112 | 92 | 110 |
| Ideal Cooling - W | 1,774 | 1,069 | 1,362 | 861 |
| Expander Tin - K | 170 | 170 | 170 | 170 |
| Expander Tout - K | 113 | 136 | 112 | 133 |
| Ideal Cooling - W | 2,154 | 1,298 | 1,654 | 1,045 |
| Gas | N2 | | | |
| Density @ 300K, 1 atm-g/L | 1.142 | | | |
| Cp - J/g K | 1.042 | | | |
| Tin - K | 300 | | | |
| Ph - MPa | 2.2 | 1.4 | 1.7 | 1.1 |
| Pl - Mpa | 0.8 | 0.8 | 0.6 | 0.6 |
| Pr | 2.75 | 1.75 | 2.83 | 1.83 |
| Flow rate - g/s | 51.5 | 51.5 | 38.6 | 38.6 |
| Adiabatic power - kW | 5.40 | 2.79 | 4.19 | 2.28 |
| Expander Tin - K | 140 | 140 | 140 | 140 |
| Expander Tout - K | 105 | 119 | 104 | 118 |
| Ideal Cooling - W | 1,886 | 1,110 | 1,450 | 896 |
| Expander Tin - K | 170 | 170 | 170 | 170 |
| Expander Tout - K | 127 | 145 | 126 | 143 |
| Ideal Cooling - W | 2,290 | 1,348 | 1,761 | 1,088 |

These examples show that input power can be reduced by reducing the high pressure while holding the low pressure constant, and by reducing the low pressure. Input power is reduced by 50% in these examples. The present compressor is capable of operating at even lower levels of input power. Cooling rates are also reduced. In these examples the reduction in pressure ratios from about 2.75 to 1.75 result in a temperature change reduction in the gas of about 40%.

Comparing nitrogen with helium it is seen that the input power is slightly less and the cooling rate is slightly higher than for helium.

The invention claimed is:

1. A water vapor cryopump comprising:
a gas-balanced Brayton cycle refrigerator;
cold gas transfer lines;
a cryopanel; and
a vacuum chamber containing the cryopanel;
wherein the gas-balanced Brayton cycle refrigerator comprises at least
a compressor,
a counterflow heat exchanger, and
a gas-balanced engine.

2. A water vapor cryopump in accordance with claim 1, wherein the gas-balanced Brayton cycle refrigerator incorporates
a gas storage volume,
means for storing gas from the refrigerator at a high pressure, and
means for returning gas to the refrigerator at a low pressure;
wherein the gas storage volume holding all of the gas needed during normal operation to avoid venting or addition of gas to or from the gas-balanced Brayton cycle refrigerator.

3. A water vapor cryopump in accordance with claim 2, wherein an input power to the gas-balanced Brayton cycle refrigerator can be reduced by storing gas in the gas storage volume to reduce the low pressure or a pressure ratio.

4. A water vapor cryopump in accordance with claim 2, wherein an input power to the gas-balanced Brayton cycle refrigerator may be reduced to less than 50% of a maximum of the gas-balanced Brayton cycle refrigerator by reducing the low pressure or a pressure ratio.

5. A water vapor cryopump in accordance with claim 1, wherein the gas-balanced engine of the gas-balanced Brayton cycle refrigerator can be operated at a variable speed.

6. A water vapor cryopump in accordance with claim 1, wherein, for a maximum output of the compressor, a cool down time of the cryopanel is minimized by controlling a high pressure and a low pressure and engine speed.

7. A water vapor cryopump in accordance with claim 1, further comprising means for rapidly warming the cryopanel without warming the gas-balanced engine by circulating a portion of a warm gas flow from the compressor of the gas-balanced Brayton cycle refrigerator through the cryopanel while circulating a balance of the warm gas flow from the compressor through the gas-balanced engine and the heat exchanger.

8. A water vapor cryopump in accordance with claim 1, wherein a warm up time of the gas-balanced engine, the heat exchanger, insulated lines, and the cryopanel are minimized by opening a valve in a line that by-passes the heat exchanger.

9. A water vapor cryopump in accordance with claim 2, wherein a temperature difference between an inlet and an outlet of the cryopanel can be reduced by more than 40% from a maximum value at a given exit temperature.

10. A water vapor cryopump in accordance with claim 1, further comprising
lines between a warm inlet and an outlet of the heat exchanger and a cryopump coil inlet and a cryopump coil outlet respectively,
first valves in the lines and which are normally closed,
second valves for blocking a cold gas flow through the cold gas transfer lines; and
a by-pass valve between an outlet of the gas-balanced engine and an inlet of the gas-balanced engine to a return side of the heat exchanger.

11. A method of rapidly warming a water vapor cryopump,
the water vapor cryopump comprising
a gas-balanced Brayton cycle refrigerator;
cold gas transfer lines;
a cryopanel; and
a vacuum chamber containing the cryopanel;
wherein the gas-balanced Brayton cycle refrigerator comprises at least
a compressor,
a counterflow heat exchanger, and
a gas-balanced engine;
lines between a warm inlet and an outlet of the heat exchanger and a cryopump coil inlet and a cryopump coil outlet respectively;
first valves in the lines and which are normally closed;
second valves for blocking a cold gas flow through the cold gas transfer lines; and a by-pass valve between an outlet of the gas-balanced engine and an inlet of the gas-balanced to a return side of the heat exchanger;

the method comprising the steps of:

opening the by-pass valve;

closing the second valves that block the flow through the cold gas transfer lines;

opening the first valves; and running the gas-balanced engine.

12. A water vapor cryopump in accordance with claim 1, further comprising a connection line between a warm inlet of the heat exchanger and a cold return inlet of the heat exchanger, a first valve in the connection line and which is normally closed;

a pressure relief valve which allows flow only in a direction from a warm end of the connection line to a cold end of the connection line, second valves for blocking a flow through the cold gas transfer lines; and a by-pass valve between the outlet of the gas-balanced engine and the inlet to a return side of the heat exchanger.

13. A method of rapidly warming a gas-balanced engine and a heat exchanger of a water vapor cryopump, the water vapor cryopump comprising a gas-balanced Brayton cycle refrigerator;

cold gas transfer lines;

a cryopanel; and a vacuum chamber containing the cryopanel;

wherein the gas-balanced Brayton cycle refrigerator comprises at least a compressor, the counterflow heat exchanger, and a gas-balanced engine;

a connection line between a warm inlet of the heat exchanger and a cold return inlet of the heat exchanger, a first valve in the connection line and which is normally closed;

a pressure relief valve which allows flow only in a direction from a warm end of the connection line to a cold end of the connection line;

second valves for blocking a flow through the cold gas transfer lines; and a by-pass valve between the outlet of the gas-balanced engine and the inlet to a return side of the exchanger;

the method comprising the steps of:

opening said by-pass valve;

closing the second valves that block the flow through the cold gas transfer lines;

opening the first valve; and running the gas-balanced engine.

* * * * *